US006722855B2

(12) United States Patent
Tien-Tsai

(10) Patent No.: US 6,722,855 B2
(45) Date of Patent: Apr. 20, 2004

(54) OIL PUMPING DEVICE

(76) Inventor: Tseng Tien-Tsai, No. 771, Lin Sen Rd., Wu Feng Hsiang, Taichung Hsien (TW)

( * ) Notice: Subject to any disclaimer, the term of this patent is extended or adjusted under 35 U.S.C. 154(b) by 15 days.

(21) Appl. No.: 10/156,145

(22) Filed: May 29, 2002

(65) Prior Publication Data

US 2003/0223881 A1 Dec. 4, 2003

(51) Int. Cl.[7] ..... F04B 23/08

(52) U.S. Cl. ..... 417/199.1; 417/41; 417/118; 417/148; 137/202; 137/365

(58) Field of Search ..... 137/202, 205, 137/365; 184/1.5; 417/40, 41, 118, 148, 374, 199.1

(56) References Cited

U.S. PATENT DOCUMENTS 2,477,450 A * 7/1949 Gray ..... 184/1.5
5,002,154 A * 3/1991 Chen ..... 184/1.5
5,449,029 A * 9/1995 Harris ..... 141/198
5,450,924 A * 9/1995 Tseng ..... 184/1.5
6,092,390 A * 7/2000 Griffith, Jr. ..... 62/468
6,422,261 B1 * 7/2002 DeCapua et al. ..... 137/202
6,439,206 B1 * 8/2002 Shimamura et al. ..... 123/516
6,513,541 B1 * 2/2003 Herlihy ..... 137/202
6,558,138 B2 * 5/2003 Tseng ..... 417/374

* cited by examiner

*Primary Examiner*—Justine R. Yu
*Assistant Examiner*—Emmanuel Sayoc
(74) *Attorney, Agent, or Firm*—Rosenberg, Klein & Lee

(57) ABSTRACT

A manual/pneumatic oil pumping device having a housing defining therein an oil reserving space and an upper cover. A floating board is disposed in the oil reserving space. The upper cover is equipped with a manual air sucking mechanism, a pneumatic air sucking mechanism and an oil sucking tube. The pneumatic air sucking mechanism is provided with a controlling unit. The control controlling unit includes a seat body, a valve body, a sleeve and a movable block. The movable block is fitted in the sleeve and has a downward extending projecting post. When the oil is pumped to fill up in the oil reserving space, the projecting post is upward pushed by the floating board to make movable block move upward. At this time, the leakproof washer on the movable block seals the through hole of the seat body and the push pin pushes the valve body away from the through hole so as to block the air sucking passage of the pneumatic air sucking mechanism.

5 Claims, 8 Drawing Sheets

OIL PUMPING DEVICE

BACKGROUND OF THE INVENTION

The present invention relates to an oil pumping device, and more particularly to an oil pumping device that includes a manual pumping mode and a pneumatic pumping mode.

FIGS. 7 and 8 show a conventional manual/pneumatic oil pumping device having a housing 81. An oil reserving space 82 is defined in the housing 81. A floating board 83 is disposed in the oil reserving space 82. An upper cover 84 is disposed on the housing 81. The upper cover 84 is equipped with a manual air sucking mechanism 7, a pneumatic air sucking mechanism 6 and an oil sucking tube 85.

The pneumatic air sucking mechanism 6 has an air incoming passage 61 communicating with an air pressure source. A rear end of the air incoming passage 61 has an outlet 62. In addition, the air incoming passage 61 has an air sucking passage 63 communicating with the oil reserving space 82. Several stop plates 64 are disposed in the air sucking passage 63 at intervals. A seat body 65 is disposed at bottom end of the air sucking passage 63. A steel ball 66 is disposed in the seat body 65. The bottom of the seat body 65 is formed with a through hole 651. A leakproof ring 67 is positioned between the bottom of the seat body 65 and the steel ball 66. In normal state, the steel ball 66 will drop due to its own weight to block the through hole 651 and disconnect the pneumatic air sucking mechanism 6 and the oil reserving space 82 from each other. Under such circumstance, the manual air sucking mechanism 7 is operable to suck air and pump the oil.

The manual air sucking mechanism 7 has an upright pump 71 in which a piston 72 is installed. The piston rod 73 of the piston 72 passes through the upper cover 84 and is provided with a handle 74 for a user to operate. The upper cover 84 is formed with an air incoming passage (not shown) communicating with the oil reserving space 82 and the interior of the pump 71. The blocking/unblocking of the air incoming passage is controlled by a float 75. After the oil in the oil reserving space 82 ascends, the float 75 is pushed to block the air incoming passage and prevent the oil from being sucked into the pump 71.

The manual air sucking mechanism 7 includes a float 75 for blocking the air incoming passage. However, the pneumatic air sucking mechanism 6 lacks such design. In other words, when using the pneumatic air sucking mechanism 6 to suck air and pump the oil, in the case that the oil in the oil reserving space 82 ascends to the height of the seat body 65, the oil will be sucked from the through hole 651 of the seat body 65 into the air sucking passage 63 and ejected from the outlet 62.

SUMMARY OF THE INVENTION

It is therefore a primary object of the present invention to provide a oil pumping device. A movable block is fitted in a sleeve of a controlling unit. The movable block has a downward projecting post. When the oil reserving space is filled up with oil, a floating board will ascend to push the projecting post so as to move the movable block upward. At this time, a leakproof washer of the movable block will seal a through hole of the seat body. Therefore, the oil in the oil reserving space is prevented from leaking.

It is a further object of the present invention to provide the above oil pumping device in which when the leakproof washer seals the through hole on the seat body, a push pin of the movable block pushes away a valve body from the through hole of the seat body. Therefore, the space between the leakproof washer and a silicone ring keeps communicating with the air sucking passage so as to avoid clog of the controlling unit.

It is still a further object of the present invention to provide the above oil pumping device in which a weight block is fitted in the projecting post of the movable block. Therefore, when the pneumatic air sucking mechanism sucks air, the movable block will not be sucked upward so that the through hole of the seat body will not be blocked.

The present invention can be best understood through the following description and accompanying drawings wherein:

DETAILED DESCRIPTION OF THE PREFERRED EMBODIMENT

Figure 1:
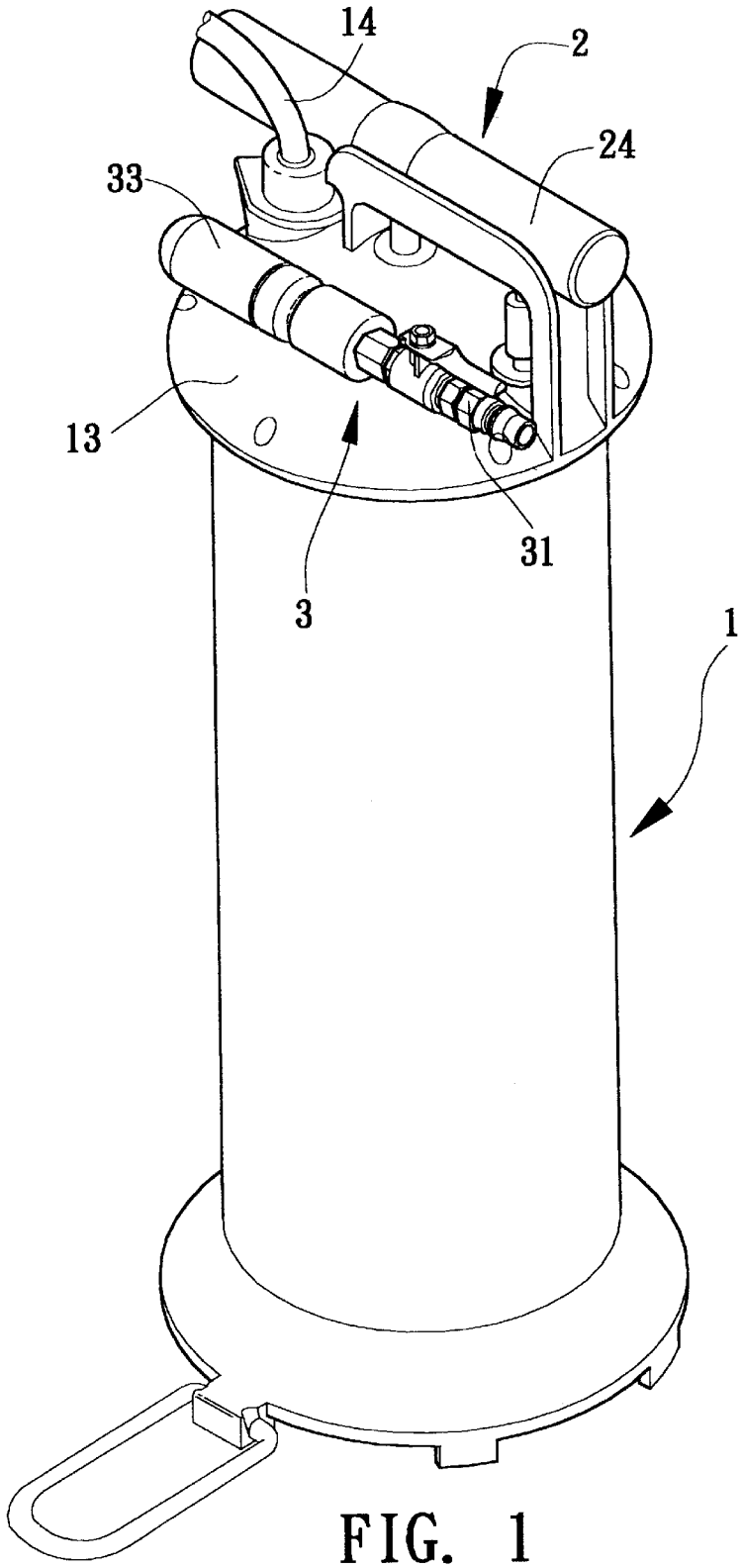
FIG. 1 is a perspective assembled view of the oil pumping device of the present invention.
Figure 2:
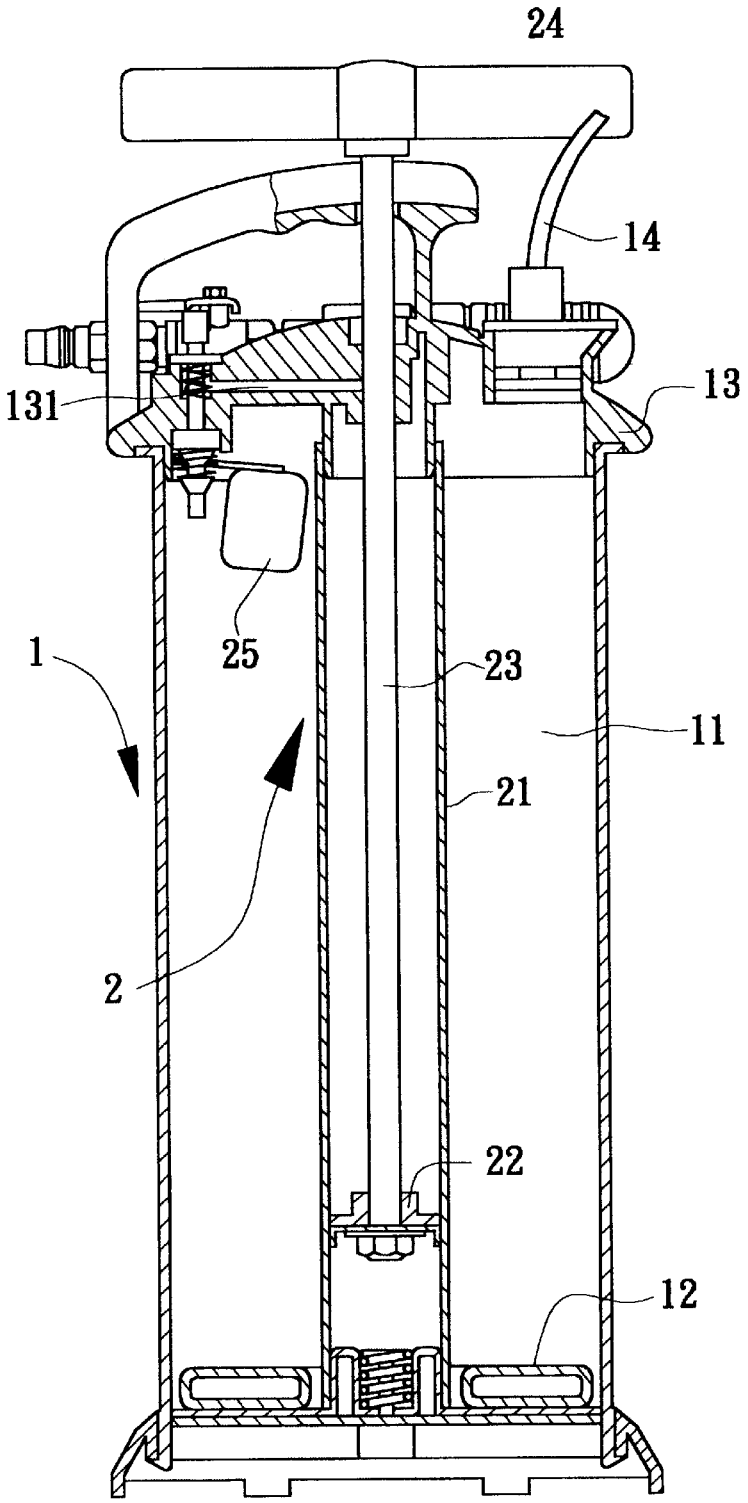
FIG. 2 is a sectional view showing the manual air sucking mechanism of the present invention.
Figure 3:
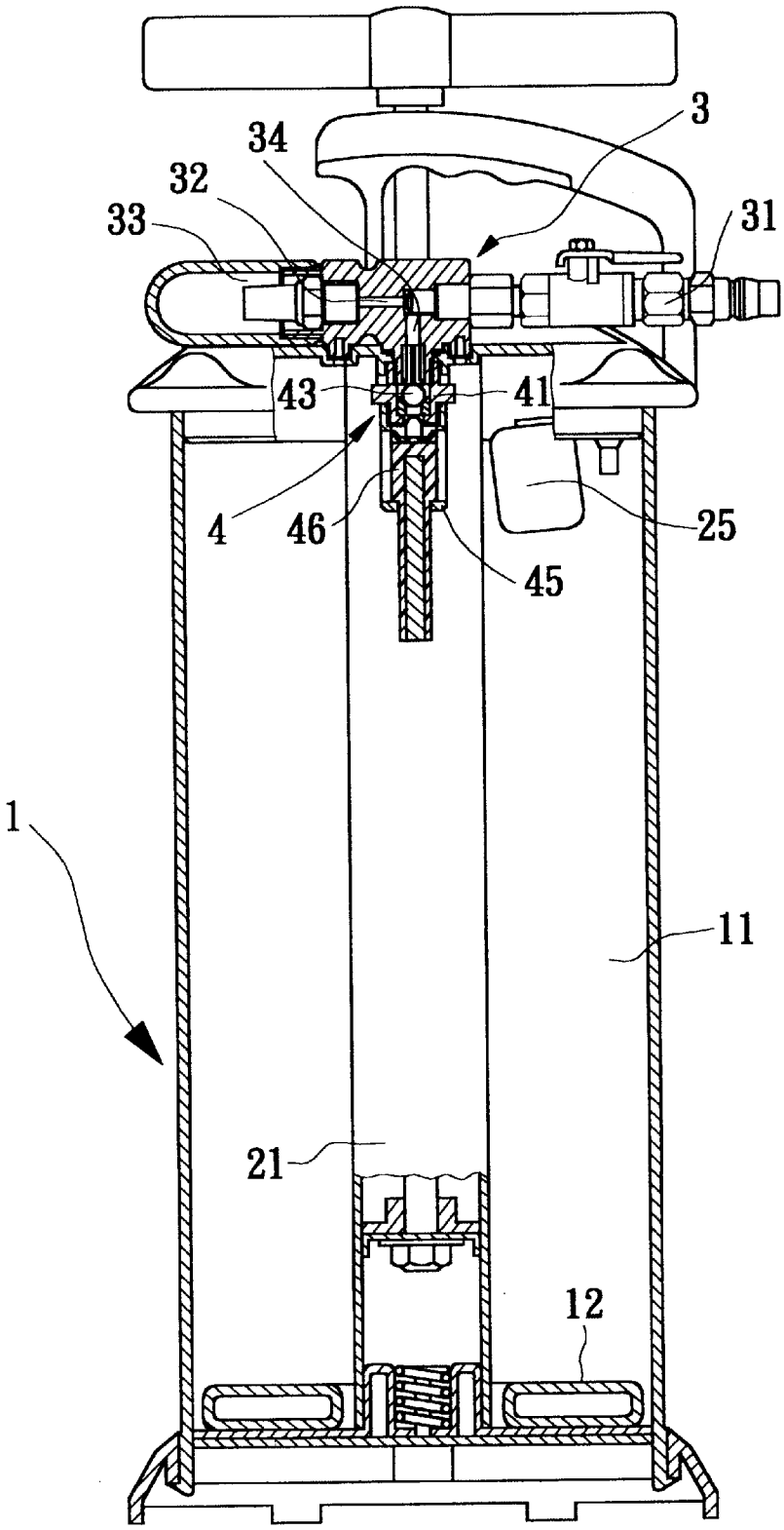
FIG. 3 is a sectional view showing the pneumatic air sucking mechanism of the present invention.
Figure 4:
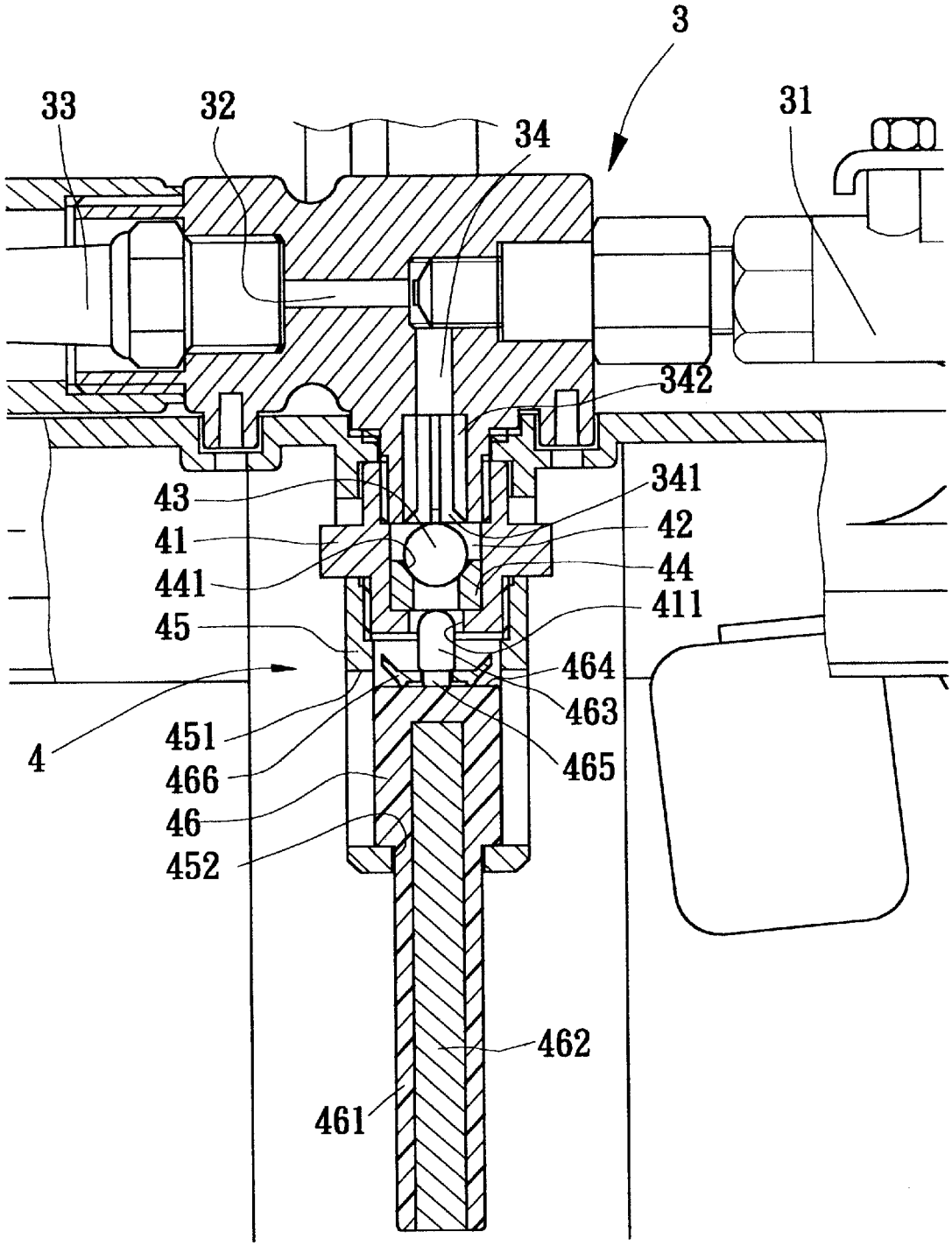
FIG. 4 is a sectional view showing the pneumatic air sucking mechanism and the controlling unit of the present invention.

Please refer to FIGS. 1 to 4. The oil pumping device in accordance with the present invention has a housing 1. An oil reserving space 11 is defined in the housing 1. A floating board 12 is disposed in the oil reserving space 11. An upper cover 13 is disposed on the housing 1. The upper cover 13 is equipped with a manual air sucking mechanism 2, a pneumatic air sucking mechanism 3 and an oil sucking tube 14.

The manual air sucking mechanism 2 has an upright pump 21 in which a piston 22 is reciprocally movably installed for pumping the air in the oil reserving space 11 out of the housing 1. The piston 22 is connected with a piston rod 23 upwardly extending through the upper cover 13 and provided with a handle 24 for a user to easily operate the manual air sucking mechanism. The upper cover 13 is formed with an air incoming passage 131 communicating with the oil reserving space 11 and the interior of the pump 21. The air in the oil reserving space 11 is pumped out of the housing 1 via the incoming passage 131 when the piston 22 is reciprocally moved in the upright pump 21. Consequently, the oil is sucked and flows into the oil reserving space 11 via the oil sucking tube 14. The air would not flow back into the oil reserving space 11 because the sucked oil occupies the room of the pumped air. The blocking/unblocking of the air incoming passage 131 is controlled by a float 25. After the oil being sucked into the oil reserving space 11 and having an ascending level, the float 25 pushes to block the air incoming passage 131 and prevent the oil from being sucked into the pump 21. When pouring the oil in the hosing 1, the upper cover 13 is detached.

The pneumatic air sucking mechanism 3 has a connector 31 mounted on the upper cover and connected with an air pressure source. The connector 31 communicates with a main flow way 32 that is longitudinally defined in the pneumatic air sucking mechanism 3. An air exhaust outlet 33 is defined in the pneumatic air sucking mechanism 3 opposite to the connector 31 and communicates with the main flow way 32. A middle section of the main flow way 32 communicates with an air sucking passage 34 that is defined in the upper cover 13 and has an opening 341 extending to the oil reserving space 11. Several stop plates 342 are disposed in an inner periphery of the air sucking passage 34 at intervals. In addition, a controlling unit 4 is connected at the opening 341 of the air sucking passage 34.

The controlling unit 4 includes a seat body 41 disposed at the opening 341 of the air sucking passage 34. A movement space 42 is defined between the seat body 41 and the air sucking passage 34. One side of the seat body 41 distal from the air sucking passage 34 is formed with a through hole 411 communicating with the movement space 42. The circumference of the through hole 411 is formed with a stop face 412. A valve body is disposed in the movement space 42 for selectively close the through hole 411. In this embodiment, the valve body is a steel ball 43. A hollow silicone ring 44 is positioned between the stop face 412 and the steel ball 43 in the seat body 41. The silicone ring 44 permits the through hole 411 to communicate with the movement space 42. The silicone ring 44 is formed with a conic dent 441 corresponding to the steel ball 43. The outer diameter of the steel ball 43 is larger than the minimum diameter of the dent 441. In normal state, the steel ball 43 due to its own weight drops onto the dent 441 to block the through hole 411 so as to disconnect the pneumatic air sucking mechanism 3 from the oil reserving space 11. Under such circumstance, the manual air sucking mechanism 2 is operated to pump oil.

One side of the seat body 41 opposite to the air sucking passage 34 is connected with a sleeve 45 in which multiple inlets 451 is defined and radially extend through the sleeve 45. One end of the sleeve 45 distal from the seat body 41 is formed with a hole 452.

A movable block 46 is longitudinally movably received in the sleeve 45. The movable block 46 has a projecting 461 extending through the hole 452 in the sleeve 45 and into the oil reserving space 11. A weight block 462 is fitted in the projecting post 461. An end face 463 of the movable block 46 proximal to the seat body 41 has a push pin 464 upwardly extending therefrom and corresponding to the through hole 411 of the seat body 41. The outer diameter of the push pin 464 is smaller than the inner diameter of the through hole 411, whereby air in the oil reserving space 11 can flow through the gap between the push pin 464 and the an inner periphery of the through hole 411. The push pin 464 has a small diameter section 465 formed adjacent to the end face 463. A leakproof washer 466 is mounted around the small diameter section 465. When the projecting post 461 of the movable block is upward pushed by the floating board 12 to make the leakproof washer 466 abut against the seat body 41 to block the through hole 411, the push pin 464 pushes away the steel ball 43 so as to unblock the through hole 411.

Figure 5:
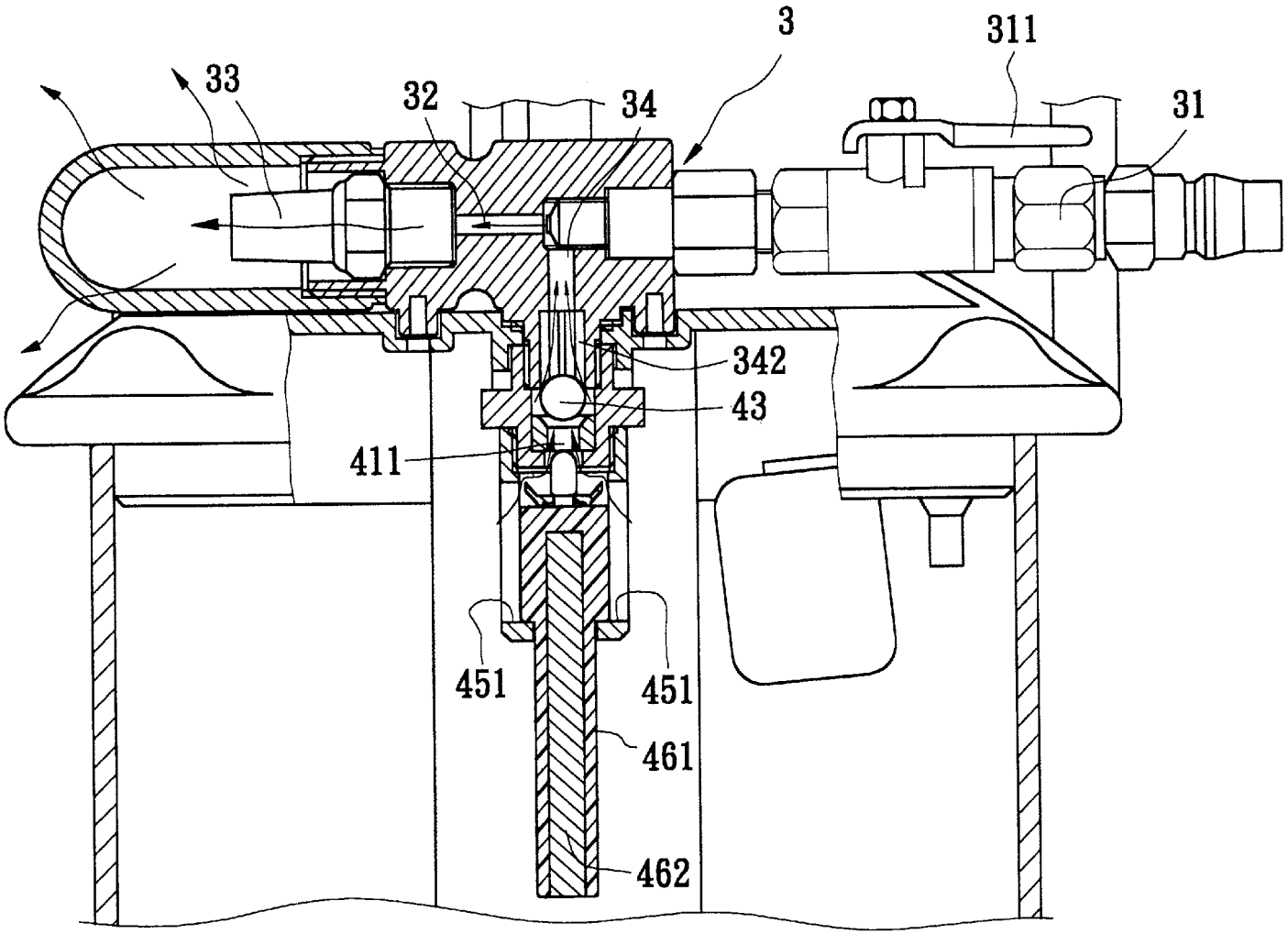
FIG. 5 is a sectional view showing the use of the pneumatic air sucking mechanism of the present invention.

Referring to FIG. 5, when a switch 311 of he connector 31 of the pneumatic air sucking mechanism 3 is switched on, the high pressure air coming from the air pressure source will flow into the main flow way 32. When the air in the main flow way 32 flows through the air sucking passage 34, according to Venturi tube principle, a sucking force is applied to the air sucking passage 34 to suck the steel ball 43 upward. The steel ball 43 is stopped by the stop plates 342, whereby the through hole 411 communicates with the air sucking passage 34. At this time, the air in the oil reserving space 11 is sucked into the inlets 451 to go through the through hole 411 into the air sucking passage 34. Then the air is exhausted from the air exhaust outlet 33.

The movable block 46 is heavier and provided with a weight block 462 so that it will not be sucked upward. Therefore, the inlets 451 keep communicating with the through hole 411.

Figure 6:
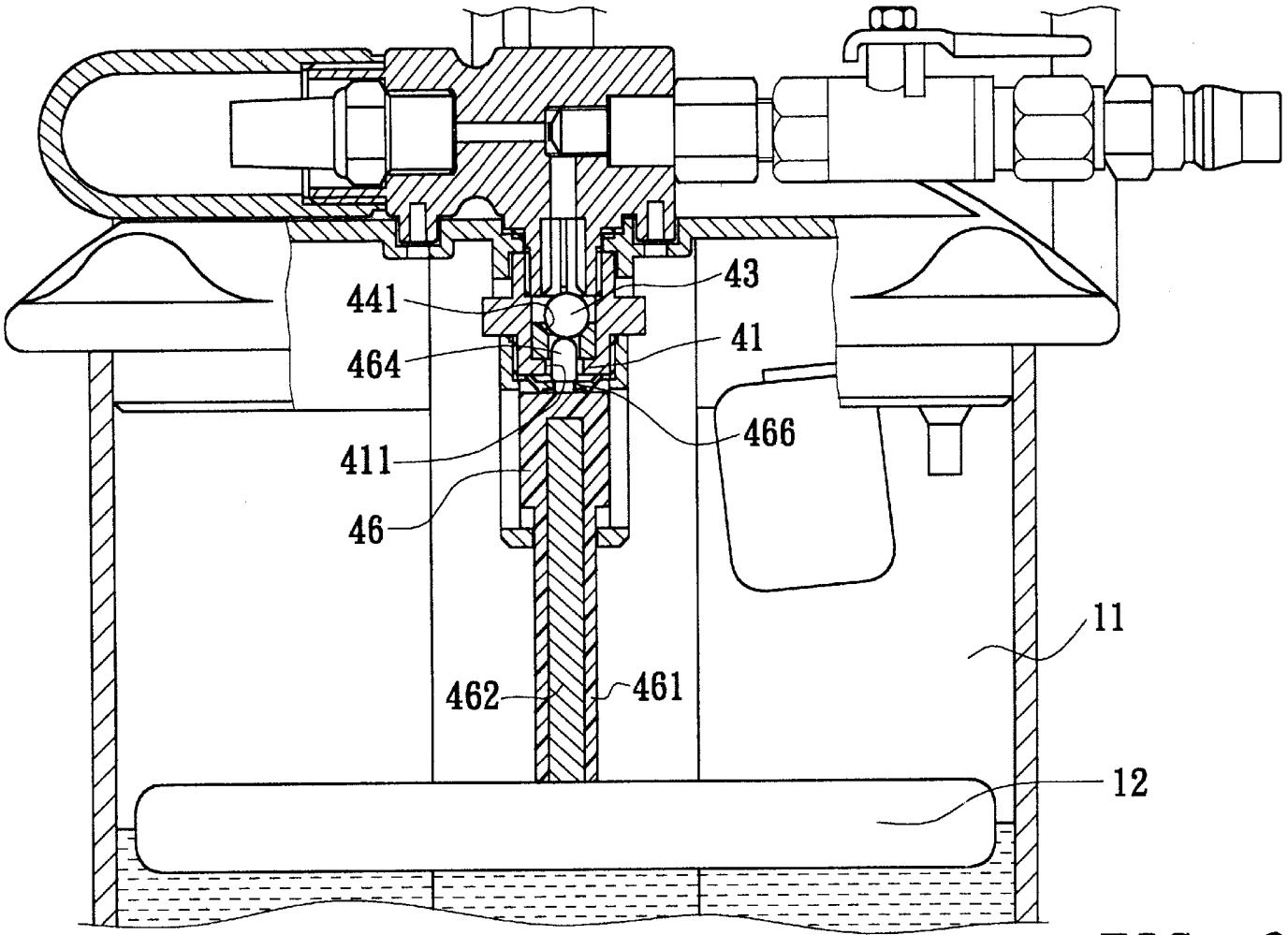
FIG. 6 is a sectional view showing the controlling unit of the present invention in a closed state.
Figure 7:
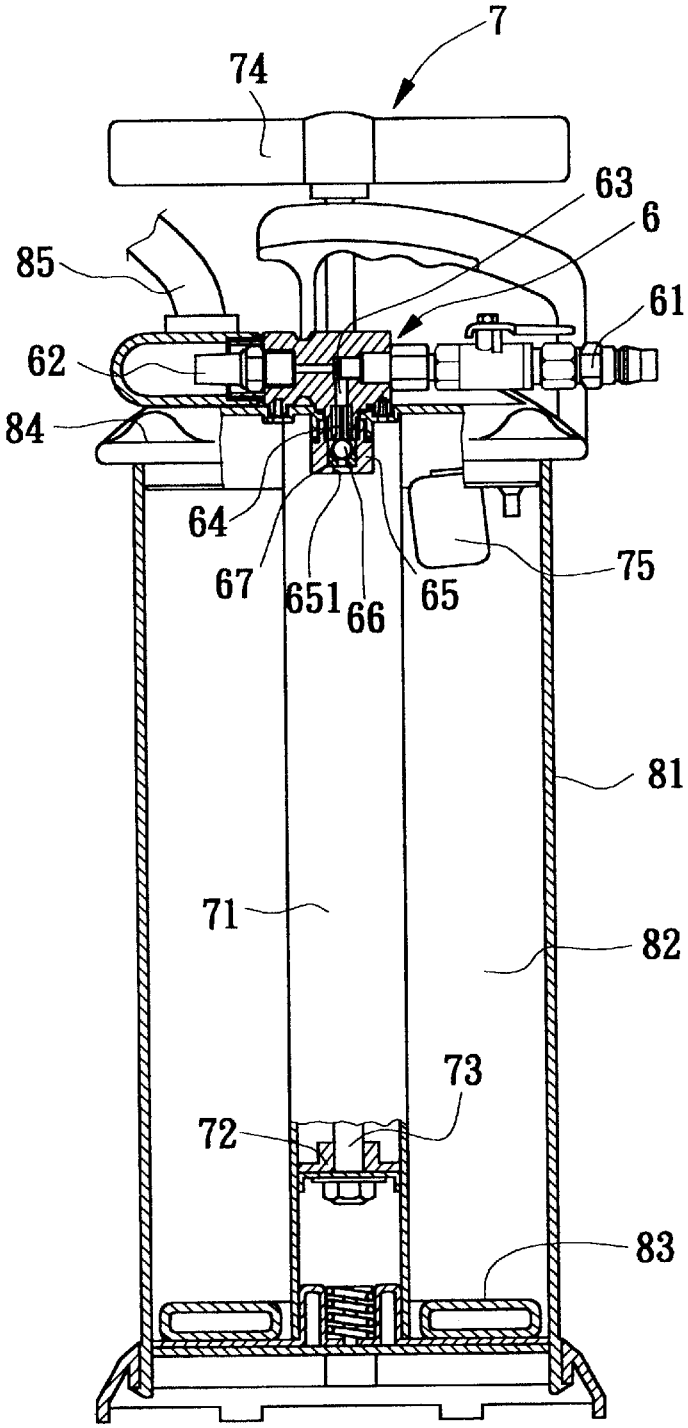
PRIOR ART FIG. 7
FIG. 7 is a sectional view of a conventional oil pumping device.
Figure 8:
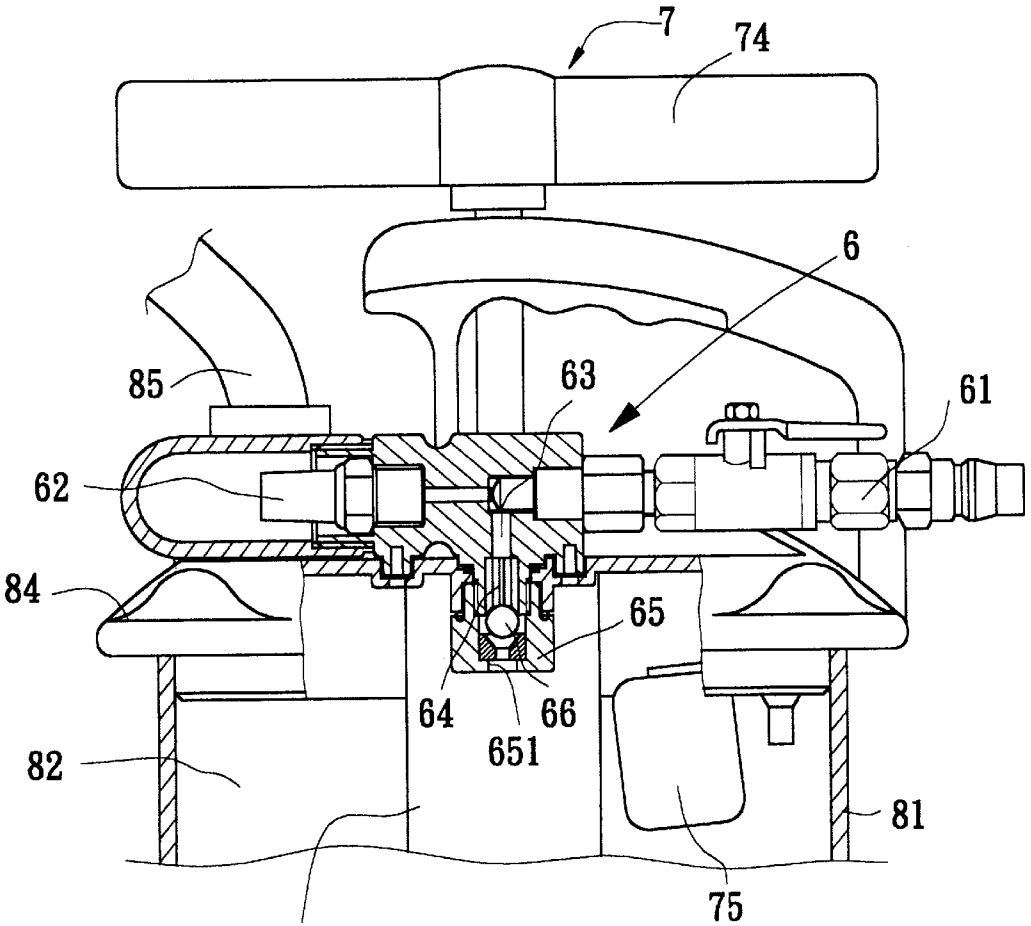
PRIOR ART FIG. 8
FIG. 8 is an enlarged view of a part of FIG. 7.

After the air in the oil reserving space 11 is sucked away, the oil reserving space 11 becomes in a negative air pressure state. At this time, the oil is sucked through the oil sucking tube 14 into the oil reserving space 11. Following the increment of the sucked in oil, the floating board 12 is gradually buoyed up by the ascending oil. When the oil in the oil reserving space 11 ascends to a certain height, the floating board 12 pushes the projecting post 461 of the movable block 46 upward until the leakproof washer 466 abuts against the seat body 41 to block the through hole 411 as shown in FIG. 6 to prevent the oil in the oil reserving space from being sucked and flowing into the air sucking passage 34.

It should be noted that when the movable block 46 is moved upward to make the leakproof washer 466 abut against the seat body 41 to block the through hole 411, the push pin 464 of the movable block 46 will extend through the through hole 411. When the switch 311 of the connector 31 is switched off and the steel ball 43 drops down due to the gravity of the steel ball 43, the push pin 464 abuts against the steel ball 43 and keep it separated from the dent 441 without blocking the through hole 411. Therefore, the space between the leakproof washer 466 and the silicone ring 44 keeps in a communicating condition with the air sucking passage 34.

Otherwise, in the case that the steel ball 43 drops onto the dent 441 to block the through hole 411, the space between the leakproof washer 466 and the silicone ring 44 will be vacuumed. Under such circumstance, after the oil is drained from the oil reserving space 11, the movable block 46 will be unable to drop down to clog the controlling unit 4. The pneumatic air sucking mechanism 3 will be unable to further operate for sucking air and pumping oil when the controlling unit 4 is clogged.

According to the above arrangement, the oil pumping device in accordance with the present invention has the following advantages:

1. The movable block 46 is reciprocally movably received in the sleeve 45 and has a downward projecting post 461 downward extending therefrom. When the oil reserving space 11 is filled up with oil, the floating board 12 will ascend to push the projecting post 461 so as to move the movable block 46 upward. At this time, the leakproof washer 466 of the movable block 46 will seal the through hole 411 of the seat body 41 to prevent the oil in the oil reserving space 11 from leaking.
2. When the floating board 12 pushes the projecting post 461 to move the movable block 46 upward and the leakproof washer 466 seals the through hole 411, the push pin 464 will push away the steel ball 43. Therefore, the space between the leakproof washer 466 and the silicone ring 44 keeps in a communicating condition with the air sucking passage 34 so as to prevent the controlling unit 4 from being clogged.
3. The weight block 462 is fitted in the projecting post 461 of the movable block 46. Therefore, when the pneumatic air sucking mechanism 3 sucks air, the movable block 46 will not be sucked upward so that the through hole 411 of the seat body 41 will not be blocked.

Although the invention has been explained in relation to its preferred embodiment, it is to be understood that many other possible modifications and variations can be made without departing from the spirit and scope of the invention as hereinafter claimed.

What is claimed is:

1. An oil pumping device comprising a housing having an oil reserving space defined therein, a floating board being disposed in the oil reserving space, an upper cover being disposed on the housing and equipped with a manual air sucking mechanism, a pneumatic air sucking mechanism and an oil sucking tube, said pneumatic air sucking mechanism including an air sucking passage defined in the upper cover and having an opening extending into the oil reserving space, several stop plates being disposed in an inner periphery of the air sucking passage at intervals, the pneumatic air sucking mechanism being provided with a controlling unit, when the controlling unit is opened, the oil reserving space communicating with the pneumatic air sucking mechanism, whereby the pneumatic air sucking mechanism is capable of sucking air out of the oil reserving space for pumping oil, when the controlling unit is closed, the oil reserving space being disconnected from the pneumatic air sucking mechanism, whereby the manual air sucking mechanism is operable for pumping oil, wherein the improvement comprises:

the controlling unit including:

a seat body disposed at the opening of the air sucking passage, a movement space being defined between the seat body and the air sucking passage, one side of the seat body distal from the air sucking passage being formed with a through hole communicating with the movement space;

a valve body disposed in the movement space for selectively close the through hole due to the gravity thereof;

a sleeve connected to the seat body opposite to the air sucking passage, the sleeve having multiple inlets defined therein and radially extending through the sleeve, a hole defined in one end of the sleeve distal from the seat body; and a movable block longitudinally movably received in the sleeve, the movable block having a projecting post extending through the hole in the sleeve and into the reserving space, the movable block including an end face having a push pin upwardly extending therefrom and corresponding to the through hole of the seat body, an outer diameter of the push pin being smaller than an inner diameter of the through hole, whereby the air in the oil reserving can flow through the gap between the push pin and the an inner periphery of the through hole, a leakproof washer mounted around the push pin for selectively sealing the through hole in the seat body the push pin pushing away the valve body when the projecting post of the movable block is upward pushed by the floating board to make the leakproof washer seal the through hole in the seat body.

2. The oil pumping device as claimed in claim 1, wherein the valve body is a steel ball.

3. The oil pumping device as claimed in claim 2, wherein a silicone ring is positioned between the through hole of the seat body and the ball body in the seat body for permitting the through hole to communicate with the movement space, the silicone ring being formed with a conic dent corresponding to the steel ball for the steel ball to abut against the dent.

4. The oil pumping device as claimed in claim 1, wherein a weight block is fitted in the projecting post of the movable block to prevent the movable block from being upward moved when the pneumatic air sucking mechanism is operated.

5. The oil pumping device as claimed in claim 1, wherein the push pin has a small diameter section adjacent to the end face of the movable block and the leakproof washer is mounted around the small diameter section.

* * * * *